United States Patent [19]

Kawai et al.

[11] Patent Number: 5,016,595

[45] Date of Patent: May 21, 1991

[54] AIR-FUEL RATIO CONTROL DEVICE FOR INTERNAL COMBUSTION ENGINE

[75] Inventors: Taiyo Kawai, Susono; Narihisa Nakagawa, Numazu, both of Japan

[73] Assignee: Toyota Jidosha Kabushiki Kaisha, Toyota, Japan

[21] Appl. No.: 528,565

[22] Filed: May 24, 1990

[30] Foreign Application Priority Data

May 29, 1989 [JP] Japan ..... 1-135087

[51] Int. Cl.[5] ..... F02M 51/00

[52] U.S. Cl. ..... 123/478; 123/489; 123/440

[58] Field of Search ..... 123/478, 480, 526, 489, 123/486, 440, 494, 492, 493

[56] References Cited

U.S. PATENT DOCUMENTS

| | | | |
|---|---|---|---|
| 4,836,164 | 6/1989 | Morozumi et al. | 123/478 |
| 4,884,546 | 12/1989 | Sogawa | 123/486 |
| 4,884,548 | 12/1989 | Sogawa | 123/492 |
| 4,903,660 | 2/1990 | Sogawa | 123/478 |
| 4,911,128 | 3/1990 | Hara et al. | 123/478 |
| 4,947,820 | 8/1990 | Kushi | 123/478 |
| 4,955,348 | 9/1990 | Budde et al. | 123/478 |

FOREIGN PATENT DOCUMENTS

| | | |
|---|---|---|
| 58-59327 | 4/1983 | Japan . |
| 60-149637 | 12/1985 | Japan . |
| 62-199943 | 9/1987 | Japan . |

*Primary Examiner*—Raymond A. Nelli

*Attorney, Agent, or Firm*—Kenyon & Kenyon

[57] ABSTRACT

An air-fuel ratio control device for an internal combustion engine controls an air-fuel ratio to the lean side rather than to a stoichiometric air-fuel ratio by the use of a factor determined in accordance with inlet pipe pressure and engine speed. A throttle opening degree sensor is provided to detect a degree of throttle opening, and on the basis of the degree of throttle opening, the factor determined in accordance with the inlet pipe pressure and the engine speed is corrected in a high load range of the engine. Since the output of the throttle opening degree sensor in the high load range of the engine is more accurate than the output of a pressure sensor for detecting the inlet pipe pressure, the air-fuel ratio can be controlled accurately in the high load range by correcting the factor in accordance with the degree of throttle opening.

20 Claims, 6 Drawing Sheets

AIR-FUEL RATIO CONTROL DEVICE FOR INTERNAL COMBUSTION ENGINE

BACKGROUND OF THE INVENTION

1. Field of the Invention

The present invention relates to an air-fuel ratio control device for an internal combustion engine of the lean-burn control type wherein the air-fuel ratio is controlled to become a target air-fuel ratio on the lean side rather than a stoichiometric air-fuel ratio; in other words, a type wherein a lean mixture is used.

2. Description of the Related Art

Generally, a basic fuel injection time is determined on the basis of engine speed and inlet pipe pressure or intake air quantity. The basic fuel injection time thus determined is corrected in accordance with engine cooling water temperature, intake air temperature, and so on to determine execution fuel injection time. On the basis of this execution fuel injection time, fuel injection is performed. In addition, a lean-burn control system is known in which the air-fuel ratio is controlled on the lean side rather than on a stoichiometric air-fuel ratio. Since the peak of NOx is normally set somewhat on the lean side, deviating from the stoichiometric air-fuel ratio, the air-fuel ratio in the lean-burn control system is controlled beyond a level corresponding to the peak of NOx and to the lean side for the purpose of reducing NOx so as to improve fuel consumption.

Japanese Patent Application Laid-Open No. 62-199943 discloses a system in which lean-burn control is performed by determining a lean correction factor on the basis of inlet pipe pressure and engine speed and multiplying the basic fuel injection time by the lean correction factor.

A pressure sensor for detecting inlet pipe pressure is accurate in low and medium load ranges where a degree of opening of a throttle valve is small; however, in a high load range, the change of output of the sensor is small as compared to the change of opening of the throttle valve. That is, the resolving power of the sensor becomes degraded. Particularly, while a vehicle is running at high altitudes (high-altitude atmospheric pressure PA is lower than low altitude atmospheric pressure PAo), the output of the pressure sensor in the high load range (where inlet pipe pressure PM is substantially equal to the atmospheric pressure PA) changes little and not in proportion to the change of opening of the throttle valve. That is, an air quantity being sucked into a combustion chamber of the engine cannot be detected accurately in the high load range by the pressure sensor. Therefore, an adequate lean correction factor cannot be obtained in the high load range, with the result that lean-burn control cannot be performed accurately. Such a problem arises also where the lean correction factor is determined using an airflow meter for detecting intake air quantity rather than inlet pipe pressure.

SUMMARY OF THE INVENTION

It is an object of the present invention to provide an air-fuel ratio control device for an internal combustion engine which can accurately perform lean-burn control in the high load range as well as in the low and medium load ranges.

To achieve the foregoing object, the present invention provides an air-fuel ratio control device for an internal combustion engine which, as shown in FIG. 1A, includes a detection means (first sensor) A for detecting either inlet pipe pressure or intake air quantity, a detection means (second sensor) B for detecting engine speed, means (throttle opening degree detection sensor) D for detecting the degree of a throttle opening, a basic fuel injection time calculating means for calculating a basic fuel injection time on the basis of engine speed and either inlet pipe pressure or intake air quantity, a correction factor calculating means for calculating a correction factor on the basis of engine speed and either inlet pipe pressure or intake air quantity that is used in controlling the air-fuel ratio to the lean side rather than to a stoichiometric air-fuel ratio, a air-fuel ratio controlling means for controlling the air-fuel ratio on the basis of the basic fuel injection time and the correction factor, and a correction means E for correcting the correction factor on the basis of at least the degree of the throttle opening in a high load range of the engine.

The basic fuel injection time calculating means, correction factor calculating means, and air-fuel ratio controlling means are included in a control means C.

According to the present invention, when the detection value of the throttle opening degree detection sensor exceeds a given level indicating the high load range, the correction factor determined on the basis of engine speed and either inlet pipe pressure or intake air quantity is corrected in accordance with a correction value determined in accordance with at least the degree of the throttle opening. Since the degree of the throttle opening is detected accurately in the high load range, an inadequate correction factor based on inlet pipe pressure can be corrected and changed to an adequate correction factor in the high load range, whereby lean-burn control can be performed accurately.

As will be explained, the air-fuel ratio control device for an internal combustion engine according to the present invention can perform optical lean-burn control in the high load range as well as in low and medium load ranges.

DESCRIPTION OF THE PREFERRED EMBODIMENT

An internal combustion engine equipped with a control device according to the present invention will now be described in detail with reference to the drawings.

Figure 1A:
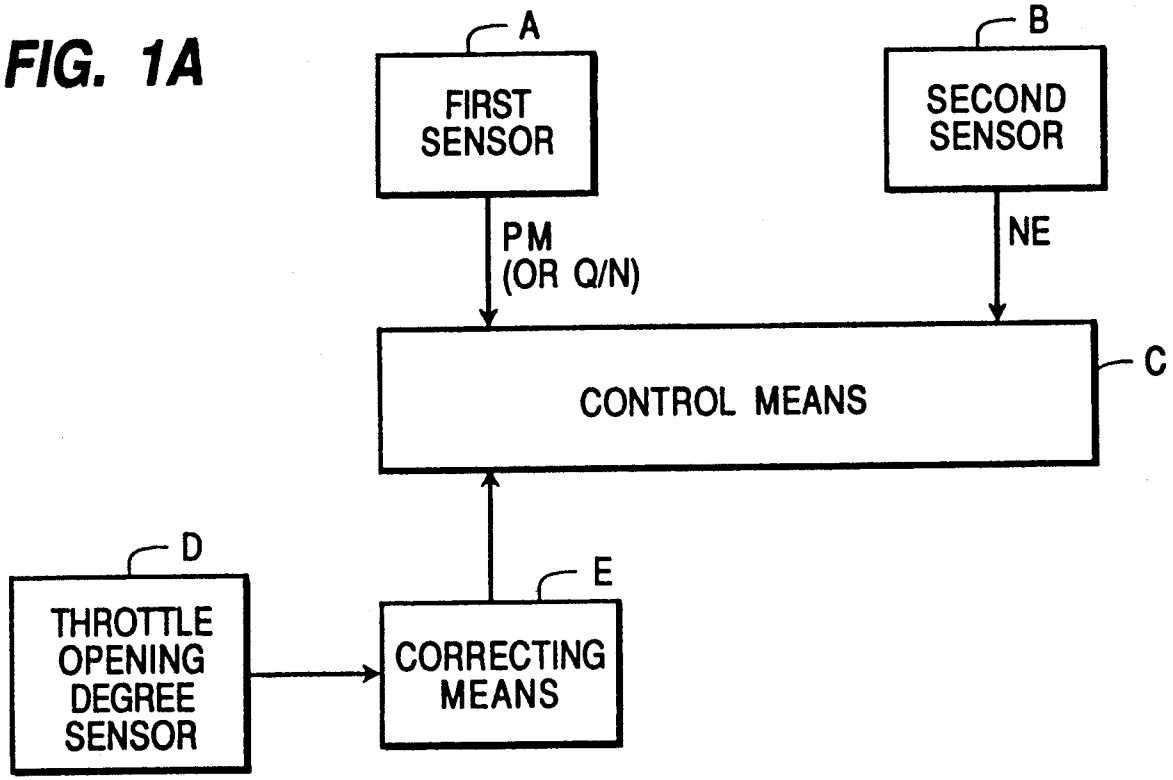
FIG. 1A is a block diagram explaining the present invention.
Figure 1B:
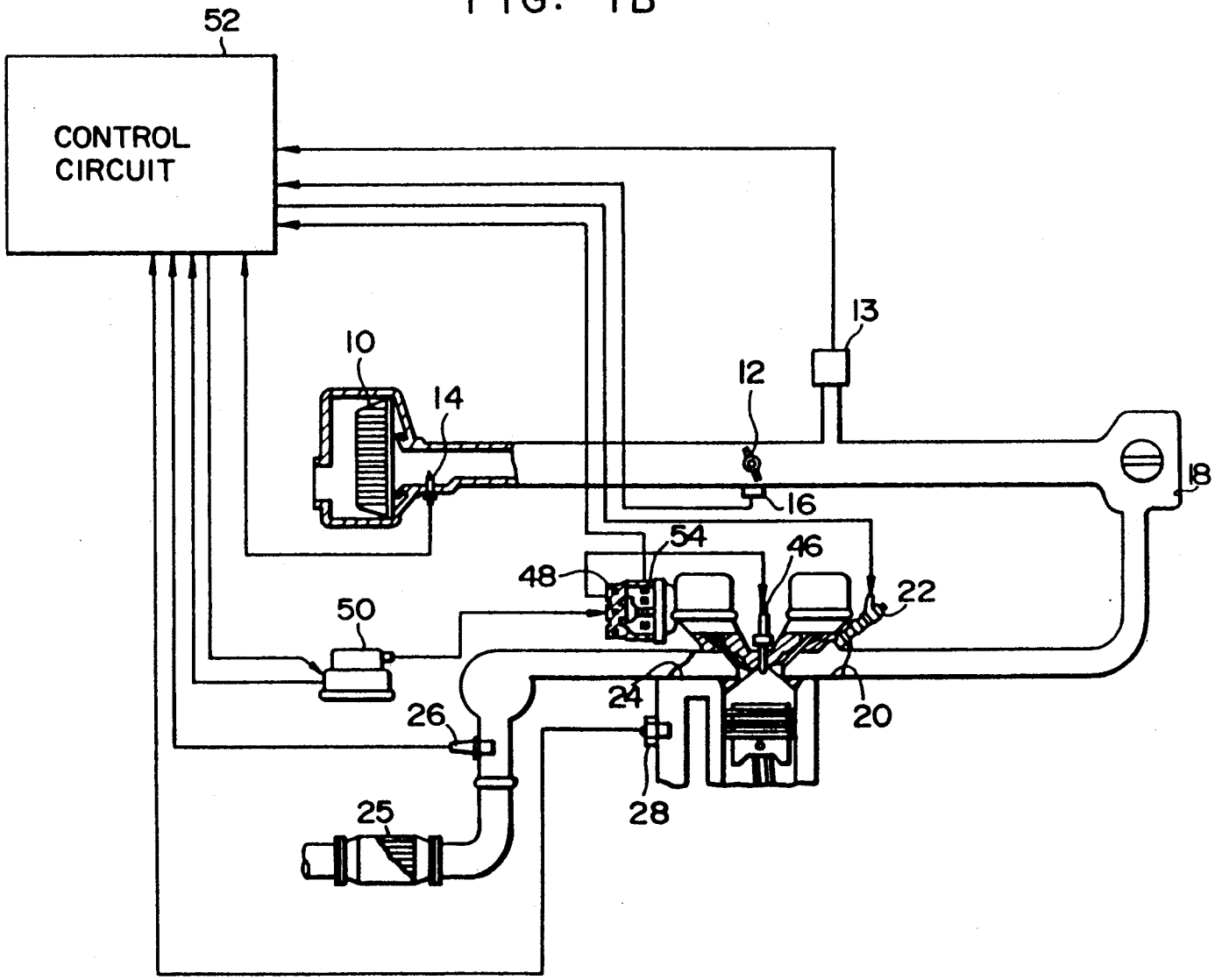
FIG. 1B is a schematic diagram of an internal combustion engine to which the present invention is applied.

FIG. 1B schematically shows an internal combustion engine. An intake air temperature sensor 14 for detecting an intake air temperature is provided in the vicinity of an air cleaner 10. Downstream, a throttle valve 12 is provided whose opening is controlled by an accelerator pedal. Attached to the throttle valve 12 is a throttle opening degree sensor 16 for delivering a signal proportional to the degree of opening of the throttle valve 12.

One end of a pipe 15 is connected downstream from the throttle opening degree sensor 16 to an inlet pipe so as to communicate with the inlet pipe. Attached to other end of the pipe 15 is a semiconductor pressure sensor 13 which detects the absolute pressure of the inlet pipe or in other words, inlet pipe pressure.

Downstream from the throttle valve 12 is a surge tank 18 which communicates with a combustion chamber(s) formed in an engine body through an intake manifold 20. A fuel injection valve 22 for each cylinder projects into the intake manifold 20.

The combustion chamber formed in the engine body communicates with a catalyst unit 25 filled with catalytic converter rhodium through an exhaust manifold 24. Attached to the exhaust manifold 24 is an $O_2$ sensor 26 which detects the density of residual oxygen in exhaust gas and delivers a signal whose polarity is inverted at the point of a stoichiometric air-fuel ratio. Attached to an engine block of the engine body is a water temperature sensor 28 for detecting an engine cooling water temperature and which projects through the engine block into a water jacket.

Each cylinder of the engine body is provided with a spark plug 46, which projects through a cylinder head into the combustion chamber and is connected via a distributor 48 and an ignitor 50 to a control circuit 52. Provided inside the distributor 48 is a rotational angle sensor 54 which comprises a signal rotor secured to a distributor shaft and a pickup secured to a distributor housing. The rotational angle sensor 54 outputs an engine speed signal to the control circuit 52 in the form of a pulse train with one pulse being generated for example, every 30 degrees, of CA (crank angle).

Figure 2:
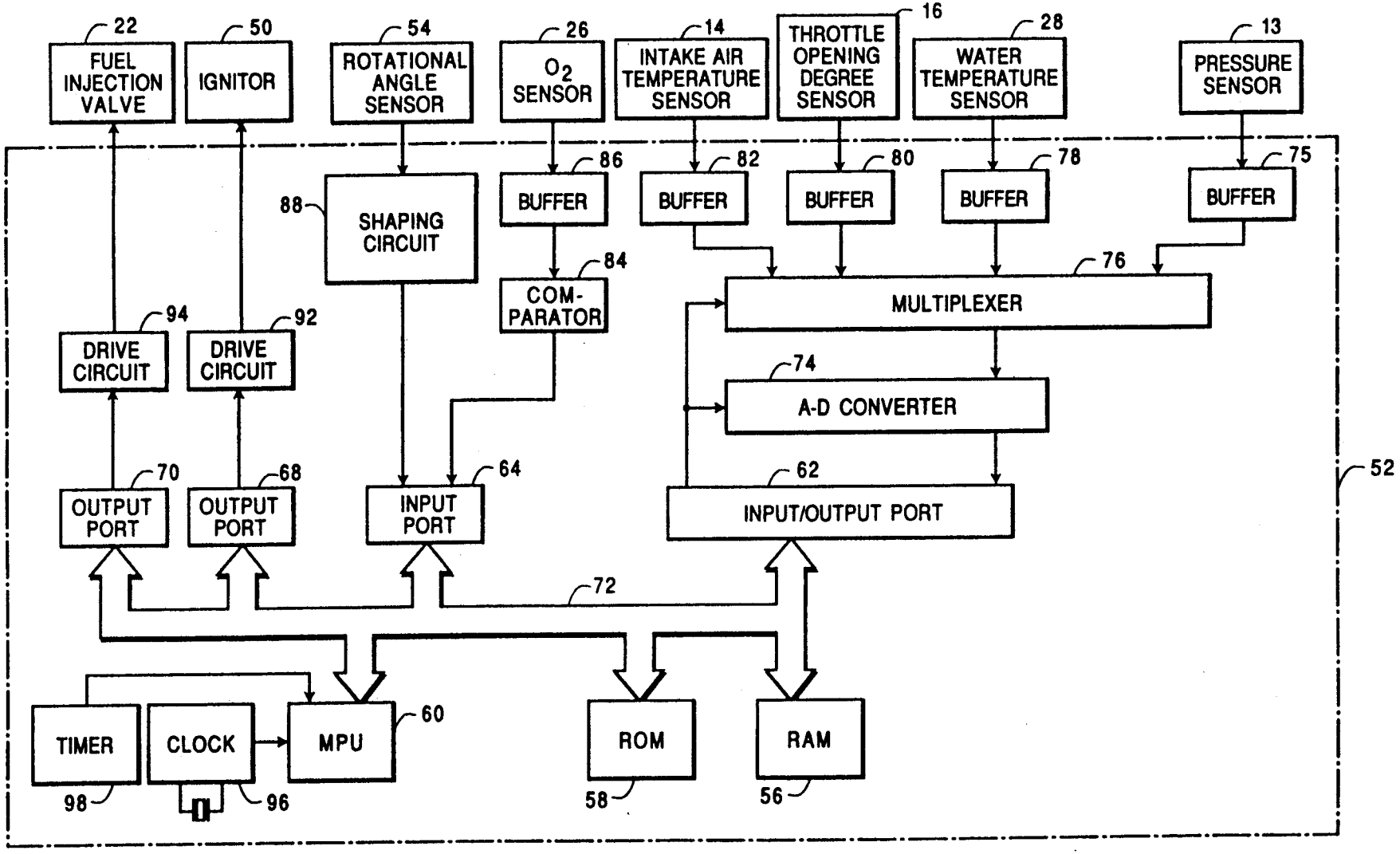
FIG. 2 is a block diagram showing in greater detail a control device shown in FIG. 1B.

The control circuit 52 includes a microcomputer. Specifically, as shown in FIG. 2, the control circuit 52 comprises a RAM 56, a ROM 58, an MPU 60, and input/output port 62, an input port 64, output ports 68 and 70, and a bus 72 including a data bus, a control bus, etc. The input/output port 62 is connected to an analog-to-digital converter (A-D converter) 74 and a multiplexer 76. The multiplexer 76 is respectively connected through a buffer 75 to the inlet pipe pressure sensor 13, through a buffer 78 with the water temperature sensor 28, through a buffer 80 with the throttle opening degree sensor 16, and through a buffer 821 with the intake air temperature sensor 14.

The MPU 60 controls the A-D converter 74 and the multiplexer 76 via the input/output port 62, and successively converts the outputs of the pressure sensor 13, water temperature sensor 28, intake air temperature sensor 14, and throttle opening degree sensor 16 from analog to digital, and stores the outputs in digital form in the RAM 56. The $O_2$ sensor 26 is connected through a comparator 84 and a buffer 86 to the input port 64. The rotation angle sensor 54 is connected through a waveform shaping circuit 88 to the input port 64.

The output port 68 is connected through a drive circuit 92 to the ignitor 50. The output port 70 is connected through a drive circuit 94 provided with a down counter to the fuel injection valve 22. In the drawings, 96 is a clock, and 98 is a timer. Previously stored in the ROM 58 are a control routine program, a basic ignition timing table, a basic fuel injection time table, and the like.

Basic fuel injection time TP is calculated using the basic fuel injection time table and on the basis of the inlet pipe pressure defined by the output of the inlet pipe pressure sensor 13 and the engine speed defined by the output of the rotational angle sensor 54 as will be described later. This basic fuel injection time TP is corrected on the basis of the outputs of the intake air temperature sensor 14, the $O_2$ sensor 26, and the water temperature sensor 28, whereby an execution fuel injection time TAU is obtained.

Similarly to the calculation of the basic fuel injection time TP, a basic ignition timing $A_{BASE}$ is calculated using the basic ignition timing table and on the basis of the outputs of the inlet pipe pressure sensor 13 and the rotational angle sensor 54, and corrected on the basis of the outputs of the intake air temperature sensor 14, the water temperature sensor 28, and the like, whereby an execution ignition timing SA is obtained.

Figure 3:
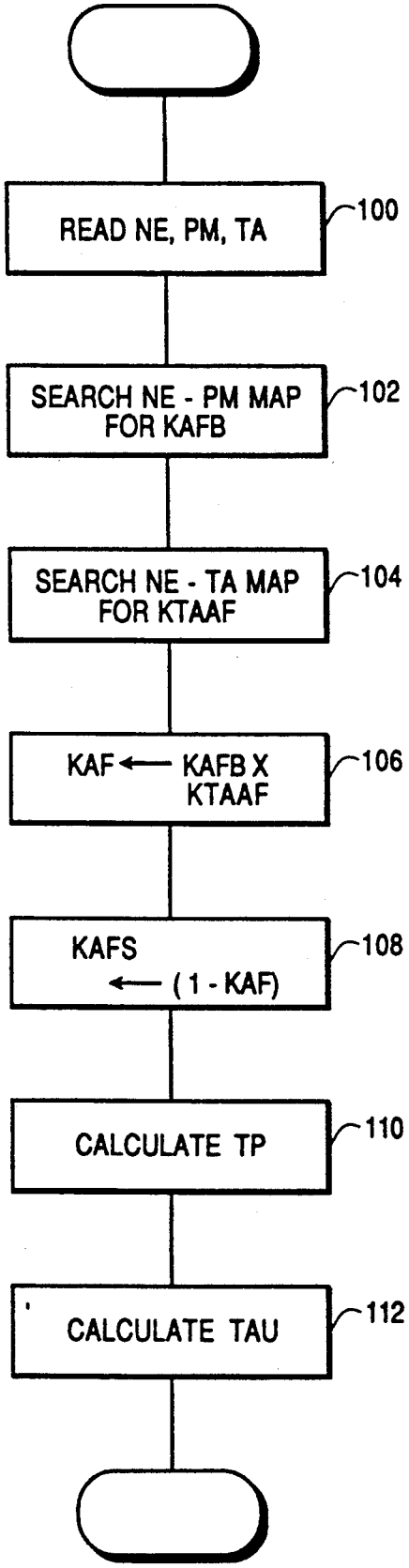
FIG. 3 is a control flow chart showing a fuel injection time calculation routine including lean-burn control.

A control routine of the embodiment will now be described with reference to the flow chart (FIG. 3). Calculation and execution routines for the execution ignition timing SA are identical with those used in controlling a conventional electronically-controlled internal combustion engine and thus will not be described.

In step 100, engine speed NE, inlet pipe pressure PM, and throttle opening TA are read.

Figure 5:
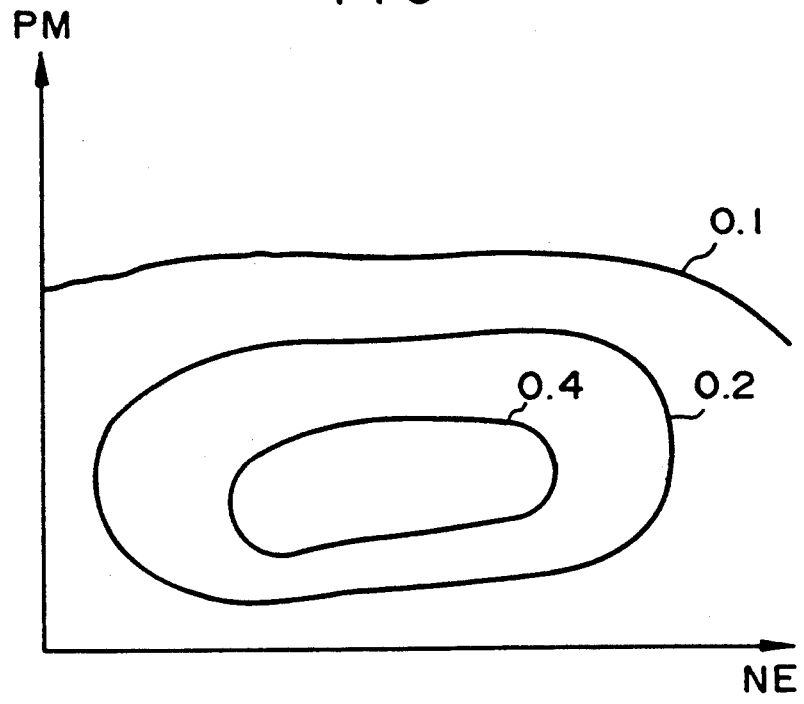
FIG. 5 is a distribution characteristic graph showing a correction factor in relation to engine speed and inlet pipe pressure.

In step 102, a correction factor KAFB is read from an NE-PM characteristic map as shown in FIG. 5 on the basis of the inlet pipe pressure. In step 104, a correction factor KTAAF is read form an NE-TA characteristic map as shown in FIG. 6 on the basis of the degree of throttle opening.

In step 106, the KAFB read in step 102 is multiplied by the KTAAF read in step 104, whereby a lean control factor KAF is obtained as below:

$$KAF = KAFB \cdot KTAAF \quad (1)$$

Figure 6:
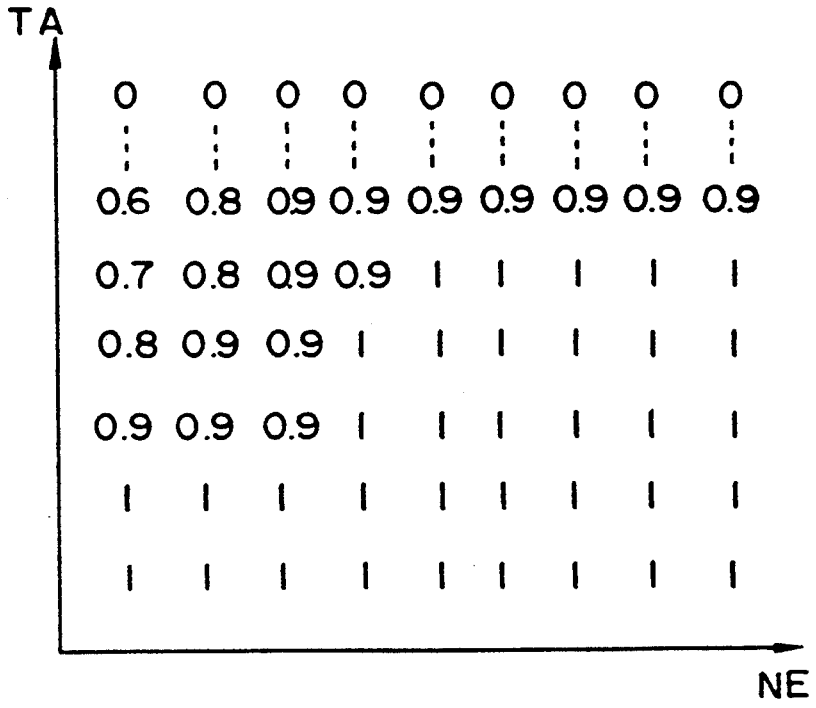
FIG. 6 is a distribution characteristic graph showing a correction factor in relation to engine speed and throttle opening.

As shown in FIG. 6, the correction factor KTAAF based on the degree of throttle opening is one (1) when the degree of throttle opening TA is smaller than a given valve. Therefore, when the degree of throttle opening is smaller than a given valve, the lean correction factor KAF of the expression one (1) is influenced by only the correction factor KAFB based on the inlet pipe pressure. When the degree of throttle opening exceeds a given valve, the correction factor KTAAF based on the degree of throttle opening becomes smaller than one (1); therefore, the lean control factor KAF is influenced by both the correction factor KAFB based on the inlet pipe pressure and the correction factor KTAAF based on the degree of throttle opening. Accordingly, in a range where the degree of throttle opening is larger than a given valve, the lean control factor decreases as the degree of the throttle opening increases even if the inlet pipe pressure PM and the engine speed NE show no change. As shown in FIG. 6, the degree of throttle opening corresponding to the correction factor KTAAF being smaller than one (1) increases as the engine speed NE increases. Further, at "wide open throttle (WOT)" or a degree of throttle opening TA2 near "full load", the correction factor KTAAF is zero (0). When the correction factor KTAAF becomes zero (0), the lean control factor KAF becomes zero (0); therefore, as will be understood from expressions (2) and (3) as described later, the air-fuel ratio is controlled to the stoichiometric air-fuel ratio.

In step 108, an execution air-fuel ratio correction factor KAFS is calculated in accordance with the following expression:

$$KAFS=(1-KAF) \quad (2)$$

In step 110, the basic fuel injection time TP is calculated on the basis of inlet pipe pressure PM and engine speed NE. The basic fuel injection time TP is corrected on the basis of the engine cooling water temperature (the output of the water temperature sensor 28), the intake air temperature (the output of the intake air temperature sensor 14), and the like, whereby the execution fuel injection time TAU is obtained. In this embodiment, lean-burn control is performed using the air-fuel ratio correction factor KAFS. That is, the execution fuel injection time TAU is calculated in accordance with the following expression:

$$TAU=(A\cdot TP)\cdot KAFS+B \quad (3)$$

where A and B are correction factors determined in accordance with the engine cooling water temperature, the intake air temperature, and the like.

After the execution fuel injection time TAU is calculated, the fuel injection execution routine controls the fuel injection valve 22 on the basis of the execution fuel injection time TAU, whereby fuel injection is performed.

Figure 4:
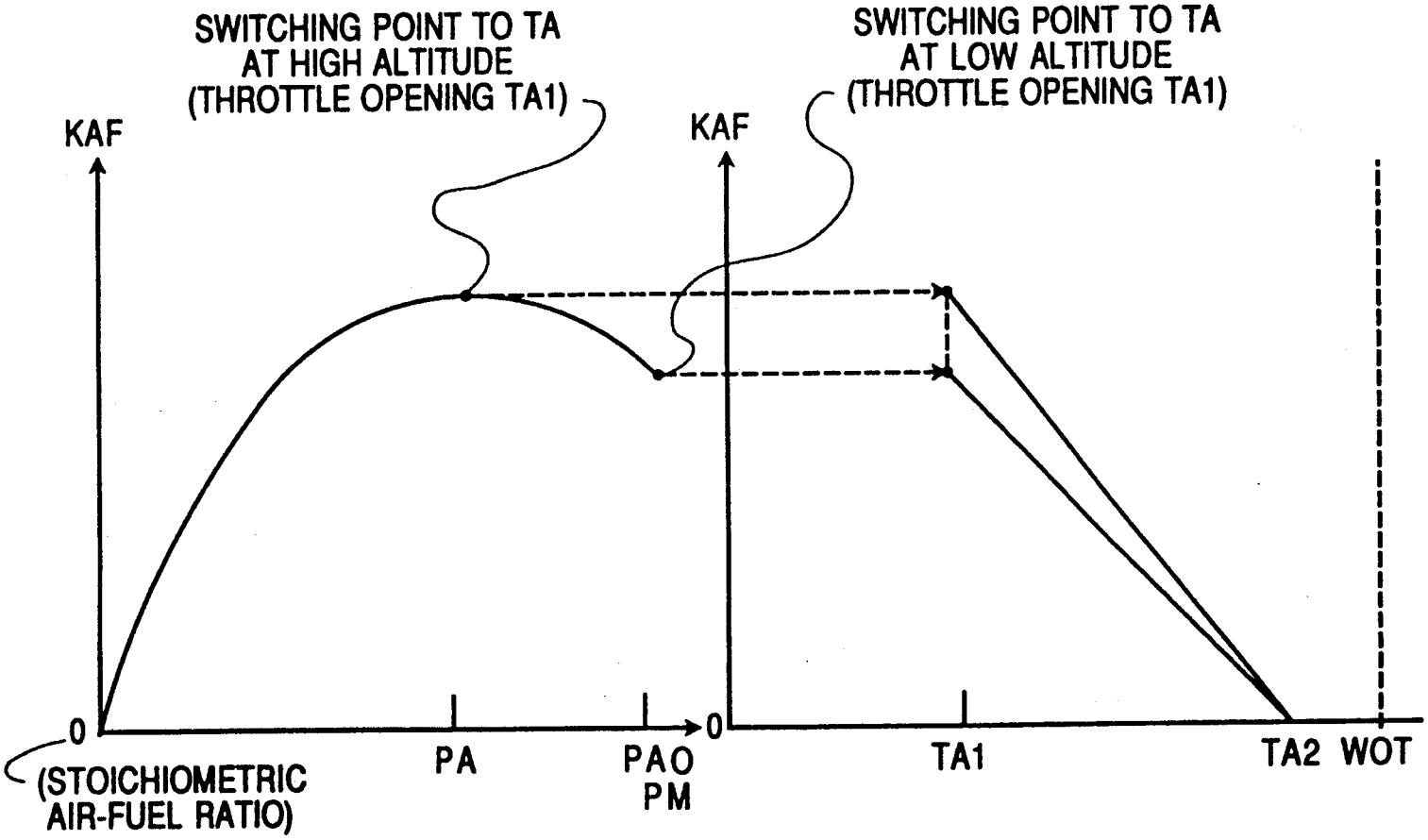
FIG. 4 is a characteristic graph showing a lean-burn control factor calculated in relation to inlet pipe pressure and throttle opening.

The characteristic of the lean control factor KAF calculated in accordance with the expression (1) which is dependent on a load change will now be described with reference to FIG. 4. This includes two types corresponding to high attitude running and low attitude running.

When the degree of throttle opening TA becomes equal to a given opening TA1, the inlet pipe pressure becomes such that the pressure during low attitude running (for example, the atmospheric pressure PAo) is higher than the pressure during high attitude running (for example, the atmospheric pressure PA). During high attitude running, the KAF reaches peak value when TA=TA1. When the degree of throttle opening TA exceeds a given valve TA1, the correction factor KTAAF based on the degree of throttle opening TA is influenced, so that the KAF decreases gradually from its value before being influenced by the high attitude running mode during high attitude running, or from its value before being influenced of the low attitude running mode during low attitude running, and becomes zero (0) when TA=TA2.

In this way, in the high load range, the setting of the lean control factor by the correction factor based on the inlet pipe pressure is not switched to the setting of the lean control factor by the correction factor based on the degree of throttle opening. Instead, in the high load range, the correction factor based on the inlet pipe pressure is influenced by the correction factor based on the degree of throttle opening. Therefore, the target air-fuel ratio can be varied smoothly irrespective of whether the attitude is high or low.

As described above, according to the present embodiment, the lean-burn control process in the high load rang (wherein it could not be performed accurately by the use of the correction factor based on the inlet pipe pressure) is influenced by the correction factor based on the degree of throttle opening. Therefore, accurate lean-burn control can be performed in all load ranges, thereby resulting in improved driveability, driving force output, fuel consumption, etc.

It should be noted that the intake air quantity may be used in place of inlet pipe pressure, and the correction factor KTAAF may be determined in accordance with only the degree of throttle opening.

What is claimed is:

1. An air-fuel ratio control device for an internal combustion engine comprising:

means for detecting one of an inlet pipe pressure and an intake air quantity;

means for detecting an engine speed;

means for detecting a degree of throttle opening;

means for calculating a basic fuel injection time on the basis of the engine speed and the one of the inlet pipe pressure and the intake air quantity;

means for calculating a correction factor on the basis of the engine speed and the one of the inlet pipe pressure and the intake air quantity that is used for controlling the air-fuel ratio to the lean side rather than to a stoichiometric air-fuel ratio;

means for controlling the air-fuel ratio on the basis of the basic fuel injection time and the correction factor; and means for correcting the correction factor on the basis of at least the degree of throttle opening in a high load range of the engine.

2. An air-fuel ratio control device for an internal combustion engine according to claim 1, wherein the correcting means corrects the correction factor such that the air-fuel ratio approaches the stoichiometric air-fuel ratio as the degree of throttle opening increases.

3. An air-fuel ratio control device for an internal combustion engine according to claim 1, wherein the correcting means corrects the correction factor such that the air-fuel ratio becomes identical with the stoichiometric air-fuel ratio when the degree of throttle opening becomes substantially full-open.

4. An air-fuel ratio control device for an internal combustion engine according to claim 2, wherein the correcting means corrects the correction factor such that the air-fuel ratio becomes identical with the stoichiometric air-fuel ratio when the degree of throttle opening becomes substantially full-open.

5. An air-fuel ratio control device for an internal combustion engine according to claim 1, wherein the correcting means corrects the correction factor on the basis of the degree of throttle opening and the engine speed.

6. An air-fuel ratio control device for an internal combustion engine according to claim 5, wherein the correcting means corrects the correction factor such that the air-fuel ratio approaches the stoichiometric air-fuel ratio as the degree of throttle opening increases.

7. An air-fuel ratio control device for an internal combustion engine according to claim 5, wherein the correcting means corrects the correction factor such that the air-fuel ratio becomes identical with the stoichiometric air-fuel ratio when the degree of throttle opening becomes substantially full-open.

8. An air-fuel ratio control device for an internal combustion engine according to claim 1, wherein the high load range of the engine corresponds to where the degree of throttle opening exceeds a given valve.

9. An air-fuel ratio control device for an internal combustion engine according to claim 8, wherein the given valve of the degree of throttle opening is set so as to increase as the engine speed increases.

10. An air-fuel ratio control device for an internal combustion engine comprising:

means for detecting one of inlet pipe pressure and intake air quantity;

means for detecting engine speed;

means for detecting a degree of throttle opening;

basic fuel injection time calculating means for calculating a basic fuel injection time TP on the basis of the engine speed and the one of the inlet pipe pressure and the intake air quantity;

first correction factor calculating means for calculating a first correction factor KAFB on the basis of the engine speed and the one of the inlet pipe pressure and the intake air quantity that is used in controlling the air-fuel ratio to the lean side rather than to a stoichiometric air-fuel ratio;

second correction factor calculating means for calculating a second correction factor KTAAF on the basis of at least the degree of throttle opening that is used in correcting the first correction factor KATB only when the degree of throttle opening exceeds a given value; and control means for correcting the basic fuel injection time TP in accordance with the first correction factor KAFB and the second correction factor KTAAF and controlling the air-fuel ratio in accordance with the thus corrected basic fuel injection time.

11. An air-fuel ratio control device for an internal combustion engine according to claim 10, wherein the second correction factor calculating means calculates the second correction factor KTAAF such that the air-fuel ratio approaches the stoichiometric air-fuel ratio as the degree of throttle opening increases.

12. An air-fuel ratio control device for an internal combustion engine according to claim 10, wherein the second correction factor calculating means calculates the second correction factor KTAAF such that the air-fuel ratio becomes identical with the stoichiometric air-fuel ratio when the degree of throttle opening becomes substantially full-open.

13. An air-fuel ratio control device for an internal combustion engine according to claim 11, wherein the second correction factor calculating means calculates the second correction factor KTAAF such that the air-fuel ratio becomes identical with the stoichiometric air-fuel ratio when the degree of throttle opening becomes substantially full-open.

14. An air-fuel ratio control device for an internal combustion engine according to claim 10, wherein the second correction factor calculating means calculates the second correction factor KTAAF on the basis of the degree of throttle opening and the engine speed.

15. An air-fuel ratio control device for an internal combustion engine according to claim 14, wherein the second correction factor calculating means calculates the second correction factor KTAAF such that the air-fuel ratio approaches the stoichiometric air-fuel ratio as the degree of throttle opening increases.

16. An air-fuel ratio control device for an internal combustion engine according to claim 14, wherein the second correction factor calculating means calculates the second correction factor KTAAF such that the air-fuel ratio becomes identical with the stoichiometric air-fuel ratio when the degree of throttle opening becomes substantially full-open.

17. An air-fuel ratio control device for an internal combustion engine according to claim 10, wherein the given valve of the degree of throttle opening is set so as to increase as the engine speed increases.

18. An air-fuel ratio control device for an internal combustion engine according to claim 10, wherein the control means controls the air-fuel ratio in accordance with $A \cdot TP(1-KATB \cdot KTAAF)+B$, where A and B are constants.

19. An air-fuel ratio control device for an internal combustion engine according to claim 18, wherein the second correction factor calculating means calculates the second correction factor KTAAF such that in a range where the degree of throttle opening exceeds a given valve, the second correction factor KTAAF gradually decreases from a value close to and smaller than one (1) to zero (0) as the degree of throttle opening increases.

20. An air-fuel ratio control device for an internal combustion engine according to claim 19, wherein the degree of throttle opening at which the second correction factor KTAAF becomes smaller than one (1) increases as the engine speed increases.

* * * * *